US009258647B2

(12) United States Patent
Lee

(10) Patent No.: US 9,258,647 B2
(45) Date of Patent: Feb. 9, 2016

(54) OBTAINING A SPATIAL AUDIO SIGNAL BASED ON MICROPHONE DISTANCES AND TIME DELAYS

(71) Applicant: Hewlett-Packard Development Company, L.P., Houston, TX (US)

(72) Inventor: Bowon Lee, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 311 days.

(21) Appl. No.: 13/778,344

(22) Filed: Feb. 27, 2013

(65) Prior Publication Data

US 2014/0241529 A1 Aug. 28, 2014

(51) Int. Cl.
*H04R 3/00* (2006.01)
*H04R 5/027* (2006.01)

(52) U.S. Cl.
CPC ..... *H04R 5/027* (2013.01); *H04R 3/005* (2013.01)

(58) Field of Classification Search
CPC ..... H04R 3/005; H04R 1/406
USPC ..... 381/91–92, 122
See application file for complete search history.

(56) References Cited

U.S. PATENT DOCUMENTS 6,041,127 A 3/2000 Elko
6,600,824 B1 7/2003 Matsuo
8,917,884 B2 * 12/2014 Matsuo ..... H04R 3/005 381/309
2003/0125959 A1 7/2003 Palmquist
2009/0003626 A1 * 1/2009 Burnett ..... 381/92
2009/0175466 A1 7/2009 Elko et al.
2010/0128894 A1 * 5/2010 Petit et al. ..... 381/92
2012/0140947 A1 * 6/2012 Shin ..... H04R 3/005 381/92
2012/0230511 A1 * 9/2012 Burnett ..... G10L 19/00 381/92
2014/0369506 A1 * 12/2014 Arrasvuori et al. ..... 381/17

FOREIGN PATENT DOCUMENTS

JP 2000188795 7/2000

OTHER PUBLICATIONS

Moore, D.C. et al., Microphone Array Speech Recognition Experiments on Overlapping Speech in Meetings, (Research Paper), IEEE international Conference on Acoustics, Speech, and Signal Processing, Apr. 6-10, 2003, pp. 497-500, vol. 5.

* cited by examiner

*Primary Examiner* — Disler Paul
(74) *Attorney, Agent, or Firm* — Hewlett-Packard Patent Department

(57) ABSTRACT

Examples disclose a method to receive a first audio signal at a first microphone positioned at an actual distance from a second microphone. Additionally, the examples disclose the method is further to receive a second audio signal at the second microphone, the second audio signal is associated with an actual time delay relative to the first audio signal. Also, the examples disclose the method is also to determine a virtual time delay corresponding to a virtual distance that is different from the actual distance and to obtain a spatial audio signal based the distances and the time delays.

18 Claims, 6 Drawing Sheets

OBTAINING A SPATIAL AUDIO SIGNAL BASED ON MICROPHONE DISTANCES AND TIME DELAYS

BACKGROUND

Microphone arrays capture audio signals. These microphone arrays may include directional microphones which are sensitive to a particular direction to capture audio signals. Other microphone arrays may include non-directional microphones, also referred to as omni-directional microphones, which are sensitive to multiple directions to capture audio signals.

BRIEF DESCRIPTION OF THE DRAWINGS

In the accompanying drawings, like numerals refer to like components or blocks. The following detailed description references the drawings, wherein.

DETAILED DESCRIPTION

Devices are becoming increasingly smaller, thus limiting the space available to place associated components such as microphones. These space constraints may prove to be a challenge in providing spatially captured audio signals. Spatial audio, as described herein, refers to producing and/or capturing audio with respect to a location of a source of the audio. For example, the closer microphone elements are to one another, the more similar these signals appear. The more similar the captured audio signals appear, the more likely the spatial aspect to these audio signals may be lost. Additionally, directional microphone elements may be used to capture spatial audio signals, but these types of microphone elements are often expensive and may need additional spacing between the microphone elements.

To address these issues, examples disclosed herein provide a method to receive a first and a second audio signal at a first and a second microphone, respectively. The first microphone is positioned an actual distance from the second microphone. Additionally, the second audio signal is associated with an actual time delay relative to the first audio signal. Capturing the first and the second audio signals with an actual distance and an actual time delay enables the microphone elements to be spaced closely together to capture spatial audio signals. This further enables the microphone elements for use with limited space.

Additionally, the example method determines a virtual time delay corresponding to a virtual distance, the virtual distance is different from the actual distance. The method obtains a spatial audio signal based on the actual distance, virtual distance, actual time delay, and the virtual time delay. Using the actual and virtual parameters, it enables the captured audio signals to be modified, providing the spatial audio signal. Obtaining the spatial audio signal enables the audio signals to be captured on devices with given space constraints. This further provides the spatial aspect to the audio signals, even though the captured audio signals may appear similar to one another due to a small actual distance "d."

In another example, the microphone elements used to capture the audio signals are non-directional microphones. These types of microphone elements are less expensive and provide a more efficient solution to capture audio signals, as non-directional microphones may capture audio from multiple directions, without sensitivity in any particular direction.

In summary, examples disclosed herein provide an enhanced audio quality by producing a spatial audio signal, even though spacing may be limited in the device housing the microphone elements. Additionally, the examples provide a more efficient method to obtain the spatial audio signal.

Figure 1:
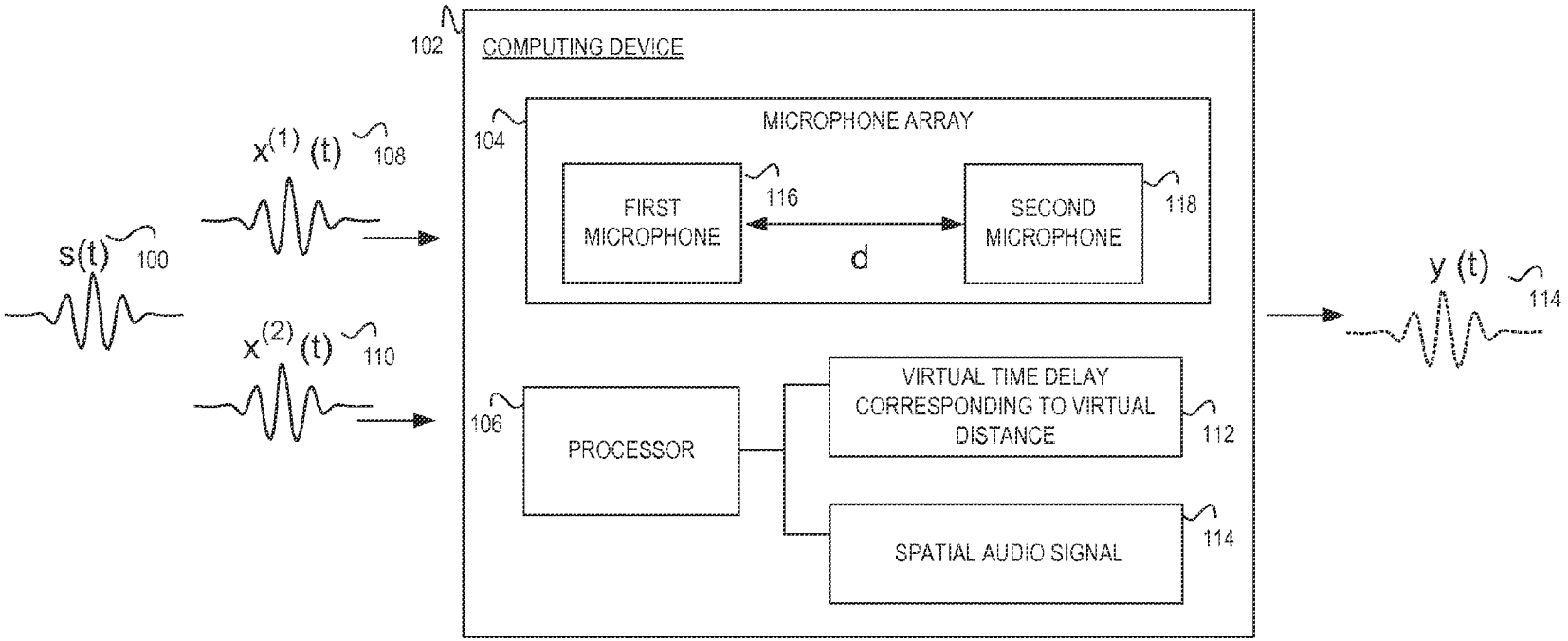
FIG. 1 is a block diagram of an example computing device including a microphone array with a first and a second microphone to receive a first and second audio signal, the example computing device is further including a processor to determine a virtual time delay corresponding to a virtual distance to obtain a spatial audio signal.

Referring now to the figures, FIG. 1 is a block diagram of an example computing device 102 including a microphone array 104 with a first microphone 116 and a second microphone 118. These microphones 116 and 118 are positioned with an actual distance "d," from each other. Additionally, the microphones 116 and 118 each receive a first audio signal 108 and second audio signal 110 respectively. The computing device 102 also includes a processor 106 to determine a virtual time delay corresponding to a virtual distance at module 112 to obtain a spatial audio signal 114. The computing device 102 captures audio through the use of the microphones 116 and 118 as such, implementations of the computing device 102 include a client device, computing device, personal computer, desktop computer, mobile device, tablet, or other type of electronic device capable of receiving audio signals 108 and 110 to produce the spatial audio signal 114.

The audio signals 108 and 110 are considered sound waves of oscillating pressure levels composed of frequencies generated from a spatial audio source 100 received at each of the microphones 116 and 118. The pressure levels as indicated by magnitudes of amplitudes in the wave forms, are captured by the microphone array 104 through sensors. The time delay and the pressure level difference between the signals 116 and 118 help determine how near or far of the location of the audio source 100. The second audio signal 110 is received at a time delay relative to when the first audio signal 108 is captured by the first microphone 116. In this regard, each audio signal 108 and 110 is captured by each of the microphones 116 and 118 at different times (i.e., different arrival times). Implementations of the audio signals 108 and 110 include an audio stream, sound waves, sequence of values, or other type of audio data.

The microphone array 104 is an arrangement of the microphones 116 and 118. In one implementation, the microphone array 104 includes microphones 116 and 118 and additional microphones not illustrated in FIG. 1. In a further implementation, the microphone array 104 consists of multiple non-directional (i.e., omni-directional) microphones to capture audio signals 108 and 110 from multiple directions.

The first and the second microphones 116 and 118 are acoustic to electric sensors which convert each of the audio signals 108 and 110 to electrical signals. The microphones 116 and 118 capture the audio signals 108 and 110 through sensing the pressure level differences when arriving at each microphone 116 and 118. In this operation, the greater the pressure level difference of the audio signal 108 or 110 indicates the source of the audio signals 108 and 110 is closer to the microphone array 104 at an angle near the side of the microphone array. In turn, the lesser the magnitude of the pressure level difference indicates the source of the audio signals 108 and 110 is further away from or at an angle perpendicular to the front of the microphone array 104. This enables the computing device 102 to recreate the spatial audio signal 114 through processing the pressure level differences. In one implementation the microphones 116 and 118 are spaced closely together (e.g., five centimeters or less), to receive audio signals 108 and 110. Spacing the microphones 116 and 118 closely together, enables the microphones 116 and 118 to capture audio with space constraints associated with the computing device 102; however, this spacing may cause challenges when recreating the spatial audio signal 114 from the captured audio signals 108 and 110. For example, since the microphones 116 and 118 are closely spaced together, there is less time delay between the audio signals 108 and 110, thus it appears the audio signals 108 and 110 are the same signal rather than two different signals. The similarity of the captured audio signals 108 and 110 is depicted in FIG. 1 with each of the audio signals 108 and 110 varying little between each other. Thus, the virtual time delay is obtained based on the virtual distance as at module 112 to recreate the spatial audio signal 114. Implementations of the microphones 116 and 118 include a transducer, sensor, non-directional microphone, directional microphone, or other type of electrical device capable of capturing sound.

The processor 106 executes module 112 to obtain the spatial audio signal 114. In another implementation, the processor 106 analyzes the audio signals 108 and 110 to determine the parameters of the spatial audio signal 114. In a further implementation, the processor 106 calculates the spatial audio signal 114 given an actual distance, "d," and a given virtual distance. This implementation is explained in further detail in the next figures. Implementations of the processor 106 include a microchip, chipset, electronic circuit, microprocessor, semiconductor, microcontroller, central processing unit (CPU), graphics processing unit (GPU), or other programmable device capable of executing module 112 to obtain the spatial audio signal 114.

The module 112 executed by the processor 106 determines a virtual time delay corresponding to a virtual distance. In another implementation, the virtual distance is a greater distance than the actual distance, "d." The virtual time delay and the virtual distance are considered the optimal parameters to obtain the spatial audio signal 114. For example, the virtual distance may be a pre-defined spacing which mimics the microphone array 104 spacing in a greater spacing arrangement, but due to space constraints in the computing device 102 housing the array 104, the microphones 116 and 118 may be closely spaced together. The virtual distance mimics the microphone spacing in a greater spacing arrangement in which this optimal spacing distance between the microphones 116 and 118 captures the audio signals 108 and 110 as independent signals with greater variation between the pressure level differences and the time delays than the audio signals depicted in FIG. 1. This is explained in further detail in the next figures. Implementations of the module 112 include a set of instructions, instruction, process, operation, logic, algorithm, technique, logical function, firmware, and or software executable by the processor 106 to determine a virtual time delay corresponding to a virtual distance.

The spatial audio signal 114 is recreation of the audio signals 108 and 110 with respect to a location of a source (not pictured) emitting a signal. The spatial audio signal is a modification of the audio signals 108 and 110 to capture the spatial aspect of the source emitting a signal. The greater the pressure differences (i.e., the magnitudes of amplitude) in the audio signals 108 and 110 indicates the source of the sound is closer to and located at an angle near the side of the microphones 116 and 118 to capture the audio. For example, assume the source is closer to the first microphone 116, then the first audio signal 108, $x_1(t)$, will have a larger magnitudes of amplitude than the second audio signal 110 $x_2(t)$. The dashed line of the spatial audio signal 114 represents the spatial aspect to the audio signal y(t) indicating a creation of existing signals 108 and 110. The first audio signal 108 $x_1(t)$ and the second audio signal $x_2(t)$ 110 are each represented by a continuous line indicating captured audio signals at the microphones 116 and 118.

Figure 2B:
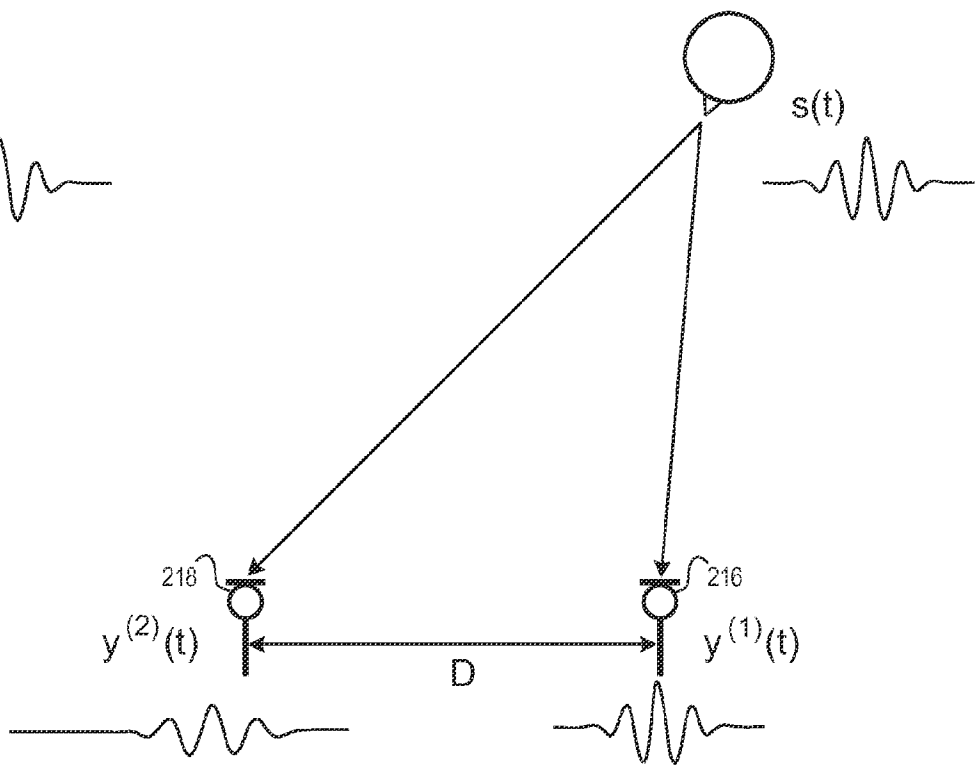
FIG. 2B is a diagram of an example virtual microphone array with a first and a second microphone associated with a virtual distance "D" and a virtual time delay.
Figure 2A:
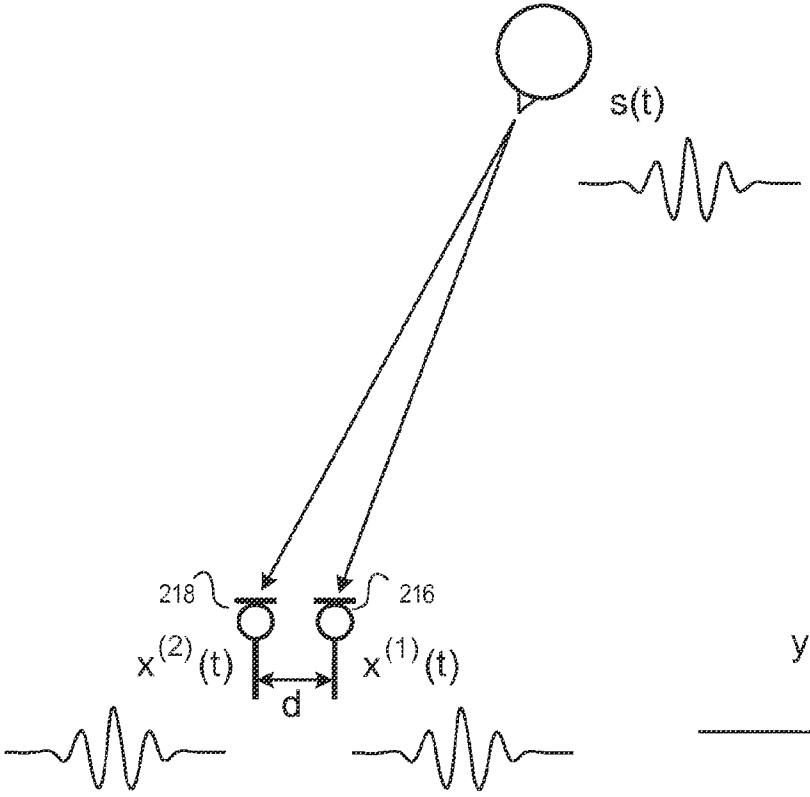
FIG. 2A is a diagram of an example microphone array with a first and a second microphone to receive audio signals from a source, the first microphone positioned at an actual distance "d" from the second microphone.

FIG. 2A is a diagram of an example microphone array with a first microphone 216 to receive a first audio signal $x^{(1)}(t)$ and a second microphone 218 to receive a second audio signal $x^{(2)}(t)$. The first microphone 216 is positioned at an actual distance, "d," from the second microphone 218. The audio signals $x^{(1)}(t)$ and $x^{(2)}(t)$, each represent what each of the microphones 216 and 218 capture with regards their location from a source s(t). The source s(t) produces a single audio signal; however each of the microphones and 216 and 218 receive their respective audio signals $x^{(1)}(t)$ and $x^{(2)}(t)$. These audio signal waveforms, $x^{(1)}(t)$ and $x^{(2)}(t)$, represent the close similarity in time between the two audio signals because of the close proximity of microphones 216 and 218, the close proximity is indicated by the actual distance "d." As explained earlier, each of the captured audio signals, $x^{(1)}(t)$ and $x^{(2)}(t)$, appear very similar to one another with little variation between the magnitude and time delay. The similarity between the captured audio signals, $x^{(1)}(t)$ and $x^{(2)}(t)$, make it difficult to determine the spatial aspect to the audio signal. The spatial aspect to the audio signal is primarily obtained by the time delay and pressure level differences between the captured audio signals, $x^{(1)}(t)$ and $x^{(2)}(t)$. As such, since these signals appear very similar, the spatial aspect may be lost, thus virtual parameters of the optimal distance and optimal time delay are obtained to reflect the spatial aspect as in FIGS. 2B-2C. The first microphone 216 and the second microphone 218 are similar in structure and functionality to the first microphone 116 and the second microphone 118 as in FIG. 1.

FIG. 2B is an example virtual microphone array with the first microphone 216 and the second microphone 216 associated with a virtual distance, "D." The virtual distance, "D," is used to determine a virtual time delay corresponding to this distance. The virtual distance, "D," is considered an optimal distance to space the microphones 216 and 218, but due to space constraints, this distance may not be possible. For example, the virtual distance, "D," may be a larger distance than the actual distance, "d," as in FIG. 2A. The virtual distance, "D," mimics the optimal spacing between the microphones 216 and 218 to obtain the captured spatial audio signals, $y^{(1)}(t)$ and $y^{(2)}(t)$, with greater variation in the magnitude of the amplitudes and the time delay. The greater variation of the magnitude of the amplitudes and the time delay between the spatial audio signals, $y^{(1)}(t)$ and $y^{(2)}(t)$, ensures the spatial aspect of the audio signals from the sources s(t) is accurately captured. The spatial aspect of the captured audio signals, $y^{(1)}(t)$ and $y^{(2)}(t)$, is obtained based on the differences with the amplitudes and the time delay. The variation between the spatial audio signals, $y^{(1)}(t)$ and $y^{(2)}(t)$, is depicted in FIG. 2B demonstrating these signals are considered different signals. For example, $y^{(2)}(t)$ is received with a greater time delay than $y^{(1)}(t)$ as indicated with the flat line until representing the amplitudes of the spatial signal, $y^{(2)}(t)$.

Figure 2C:
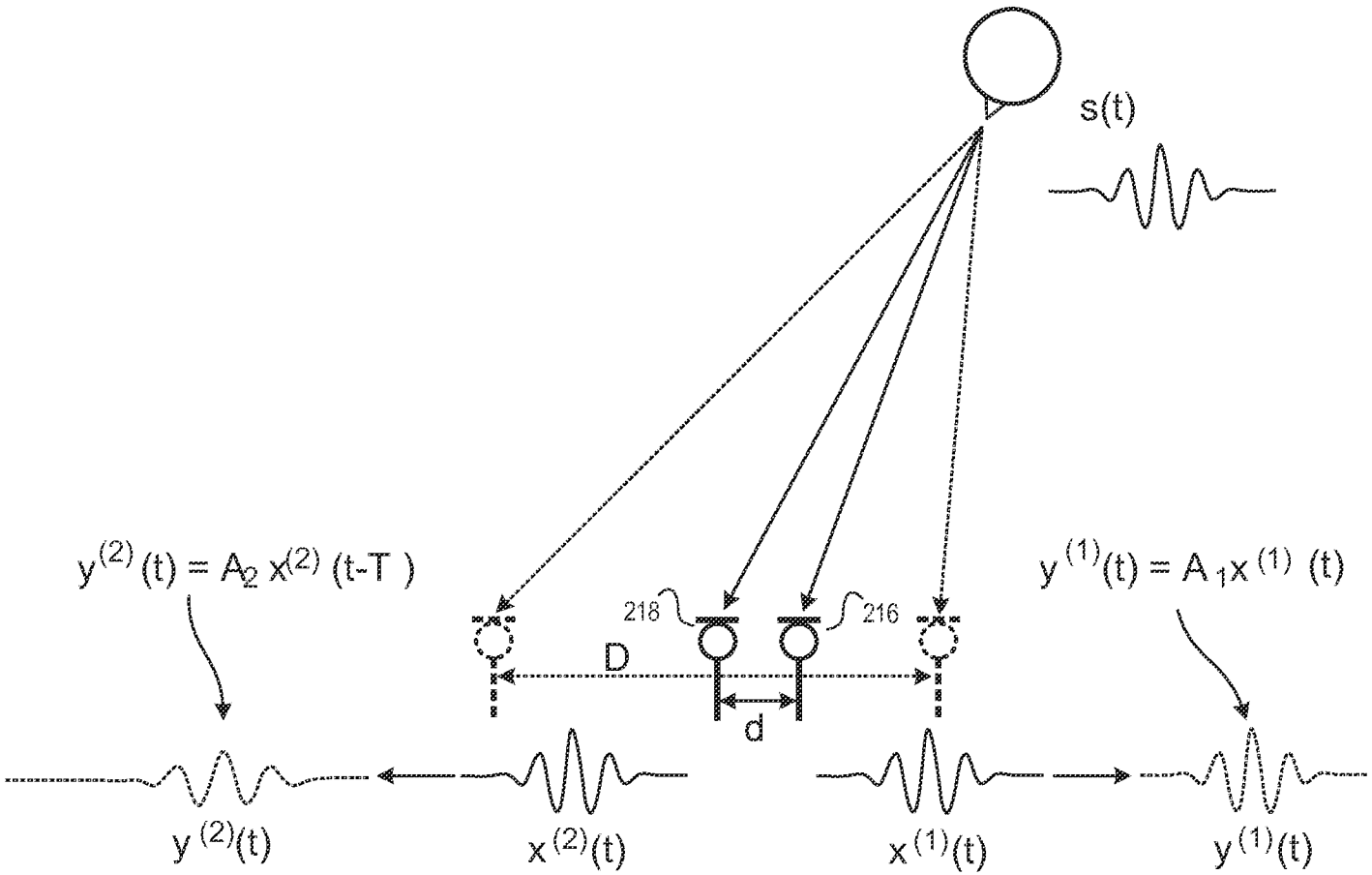
FIG. 2C is a diagram of the example microphone array and the example virtual microphone array as in FIGS. 2A-2B, to obtain a spatial audio signal based on actual and virtual distances and actual and virtual time delays.

FIG. 2C is a diagram of an example actual microphone array as in FIG. 2A and an example virtual microphone array as in FIG. 2B. The microphone arrays are used to obtain the spatial audio signals, $y^{(1)}(t)$ and $y^{(2)}(t)$, based on the actual distance, "d," virtual distance, "D," actual time delay, "δ," and virtual time delay, "T." The actual distance, "d," spaced microphone elements 216 and 218 capture signals $x^{(1)}(t)$ and $x^{(2)}(t)$, in such a way that $y^{(1)}(t)$ and $y^{(2)}(t)$ are simulated using Equations (1) and (2). With closely spaced microphone elements 216 and 218 to capture audio signals $x^{(1)}(t)$ and $x^{(2)}(t)$, the spatial audio signals $y^{(1)}(t)$ and $y^{(2)}(t)$ are simulated as if there was a larger virtual distance, "D," by obtaining the virtual time delay T and amplitudes $A_1$ and $A_2$ corresponding to the larger virtual distance, "D." These parameters are determined by given the actual time delay, "δ," actual distance, "d," and the virtual distance, "D."

The Equations (1) and (2) represent the captured spatial signals, $y^{(1)}(t)$ and $y^{(2)}(t)$, as if the microphones were spaced further apart with the virtual distance, "D," as indicated with the dashed lines.

$$y^{(1)}(t)=A_1x^{(1)}(t) \quad \text{Equation (1)}$$

$$y^{(2)}(t)=A_2x^{(2)}(t-T) \quad \text{Equation (2)}$$

Equations (1) and (2) simulate the spatial captured audio signals, using the given actual distance, "d," and virtual distance, "D," and the actual time delay, "δ" of the second audio signal $x^{(2)}(t)$ with respect to the first audio signal $x^{(1)}(t)$. The virtual time delay T is considered the time delays of the spatial audio signals, $y^{(1)}(t)$ and $y^{(2)}(t)$, based on the virtual distance, "D." The virtual time delay difference of the second spatial audio signal $y^{(2)}(t)$ with respect to the first audio spatial signal $y^{(1)}(t)$ is considered a greater time difference than the actual time delay, "δ," as it may take a longer time for the second spatial audio signal to reach the second microphone since it is a greater distance, "D." The amplitudes, $A_1$ and $A_2$ are considered magnitudes of pressure level differences sensed by each of the microphones 216 and 218. Each of these pressure level differences indicate how far the source s(t) is at each microphone 216 and 218. For example, the magnitude of amplitude $A_2$ is smaller than $A_1$ indicating the source s(t) is farther away from the second microphone 218 than the first microphone 216.

Figure 3:
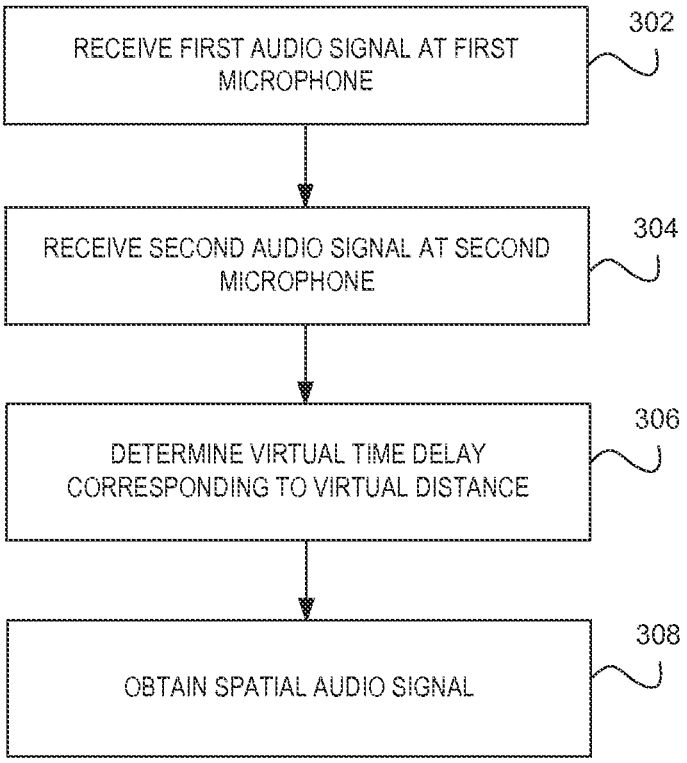
FIG. 3 is a flowchart of an example method to receive a first and a second audio signal at a first and second microphone, determine a virtual time delay corresponding to a virtual distance, and obtain a spatial audio signal.

FIG. 3 is a flowchart of an example method to receive a first and a second audio signal at a first and second microphone, determine a virtual time delay corresponding to a virtual distance, and obtain a spatial audio signal. In discussing FIG. 3, references may be made to FIGS. 1-2C to provide contextual examples. Further, although FIG. 3 is described as implemented by a processor 106 as in FIG. 1, it may be executed on other suitable components. For example, FIG. 3 may be implemented in the form of executable instructions on a machine readable storage medium, such as machine-readable storage medium 504 as in FIG. 5.

At operation 302, the first microphone receives the first audio signal. The first microphone is positioned at an actual distance, "d," from a second microphone. The actual distance, "d," is considered a close proximity distance (e.g., five centimeters or less). Positioning the microphones close together as in FIG. 2A, provides little variation between the captured audio signals, as seen with $x^{(1)}(t)$ and $x^{(2)}(t)$. Little variation makes the captured audio signals appear similar to one another as the signals received at operations 302-304 may have little variation in the arrival times at each microphone. Little variation between these received signals make it difficult to obtain the spatial audio signals as the captured audio signals at each microphone appear to be the same audio signal or may appear to be an audio signal captured at a single microphone. This decreases the level of quality as the spatial aspect to the audio signal may be lost. In another implementation, operation 302 includes the processor processing the first audio signal received at the first microphone.

At operation 304, the second microphone receives a second audio signal. The second audio signal is associated with an actual time delay relative the first audio signal. A source may emit a single audio signal, of which are captured as two audio signals at operations 302-304. The actual time delay at operation 304 may be less than the virtual time delay at operation 306. In one implementation, the second microphone receives the second audio signal some time after receiving the first audio signal at operation 302. In another implementation, operation 304 includes the processor processing the first and the second audio signals received at operations 302-304 to obtain the actual time difference between the two audio signals.

At operation 306, the processor determines a virtual time delay corresponding to a virtual distance. The virtual distance. "D," is considered a different distance than the actual distance, "d," between the microphones at operation 302. The virtual distance, "D," is a pre-defined parameter used if there were no space constraints to obtain the spatial audio capture. In one implementation, the virtual distance, "D," is considered greater than the actual distance, "d." The virtual distance, "D," mimics the microphone array spacing in a greater spacing arrangement, but due to space constraints in the device housing the microphones, the microphones may be closely spaced together. The virtual parameters, including the virtual time delay and the virtual distance, "D," mimic the optimal distance and the optimal time delay for the microphones to capture the spatial audio signals, such as $y^{(1)}(t)$ and $y^{(2)}(t)$ as in FIG. 2B. This provides spatial audio capture when the microphones are within close proximity of one another, with little variation between the received audio signals.

At operation 308, the processor obtains the spatial audio signals based on the distances and the time delays obtained at operations 302-306. In one implementation, the processor calculates the spatial audio signals given the actual distance, "d," virtual distance, "D", actual time delay "δ," and the virtual time delay "T." In this implementation, the distances, "d," and "D," may be utilized to calculate the virtual time delay T as in Equations (1) and (2) in FIG. 2C. These distances and time delays are used to obtain the magnitudes of amplitudes, $A_1$ and $A_2$ to recreate the spatial audio signals $y^{(1)}(t)$ and $y^{(2)}(t)$ as in FIG. 2C.

Figure 4:
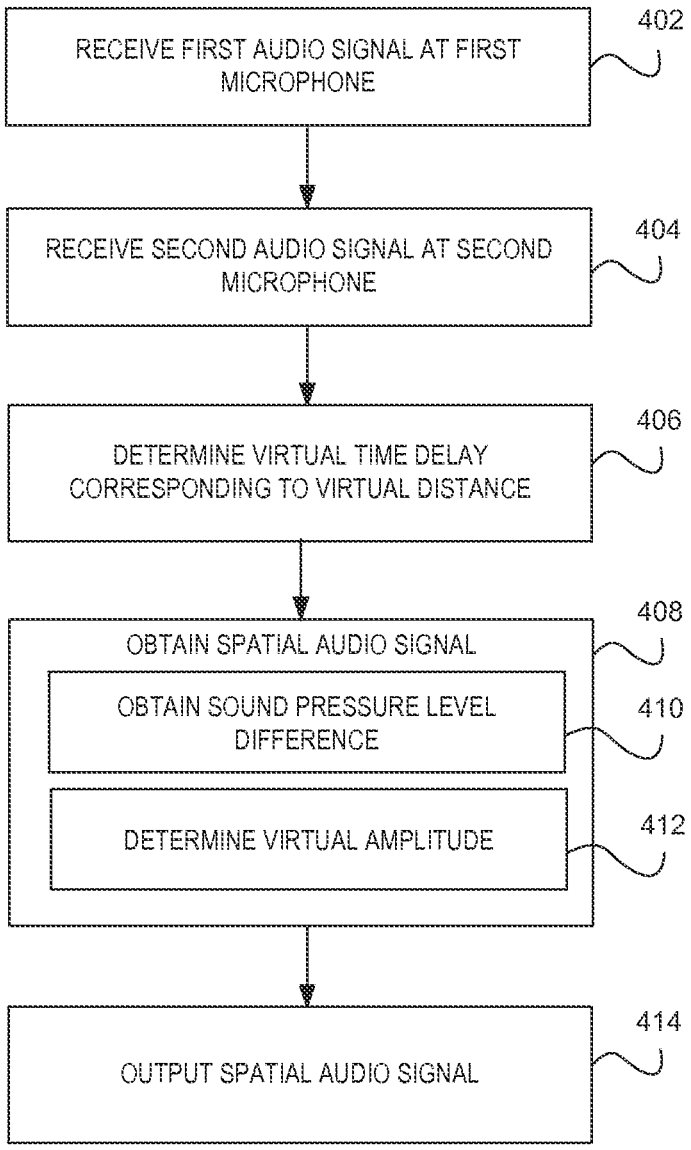
FIG. 4 is a flowchart of an example method to receive audio signals, obtain a spatial audio signal using sound pressure level differences and virtual amplitudes, and output the spatial audio signal.

FIG. 4 is a flowchart of an example method to receive audio signals, obtain a spatial audio signal using sound pressure level differences and virtual amplitudes, and output the spatial audio signal. In discussing FIG. 4, references may be made to FIGS. 2A-2C to provide contextual examples. Further, although FIG. 4 is described as implemented by a processor 106 as in FIG. 1, it may be executed on other suitable components. For example, FIG. 4 may be implemented in the form of executable instructions on a machine readable storage medium, such as machine-readable storage medium 504 as in FIG. 5.

At operations 402-406, the first microphone receives the first audio signal, the second microphone receives the second audio signal, the processor determines a virtual time delay corresponding to a virtual distance. The received audio signals at operations 402 and 404 and the virtual time delay and virtual distance are used to obtain the spatial audio signal at operation 408. Operations 402-406 may be similar in functionality to operations 302-306 as in FIG. 3.

At operation 408, the processor obtains the spatial audio signal. In one implementation, the processor calculates the spatial audio signal as in FIG. 2C. In another implementation, the processor obtains multiple spatial audio signal(s), depending on the number of captured audio signals. This dependence may include a one-to-one correspondence. Operation 408 may be similar in functionality to operation 308 as in FIG. 3.

At operation 410 the processor obtains the sound pressure level difference to produce the spatial audio signal. The sound pressure level is the difference between the pressure as at one of microphones without an audio signal and the pressure when the audio signal is received at that given microphone. The sound pressure level difference is considered the change in the sound energy over time in a given audio signal. In one implementation, operation 410 applies an inter-aural level difference (ILD), and in another implementation, operation 410 can also apply an inter-aural time difference (ITD) to obtain the spatial audio signal. In this implementation, the second audio signal received at operation 404 is associated with the actual time delay relative to the first audio signal. Applying (ILD) and/or (ITD) enables an arbitrary virtual distance, "D," to obtain the virtual time delay, "T," and virtual magnitudes for the spatial audio capture corresponding to the human's binaural hearing. The second audio signal is processed with the virtual time delay obtained at operation 406 to produce the spatial audio signal corresponding to the inter-aural time difference.

At operation 412, the processor determines the virtual amplitude of the spatial audio signal given the actual distance, virtual distance, actual time delay, and the virtual time delay. In this implementation, the processor calculates the equations (1) and/or (2) as in FIG. 2C to determine the virtual amplitude $A_1$ and/or $A_2$. In another implementation, the virtual amplitudes are used to produce the spatial audio signal corresponding to an inter-aural level difference.

At operation 414, the computing device may output the spatial audio signal obtained at operation 408. Outputting the audio signal(s) may include rendering the audio signal(s) on a display, using as input to another application, or creating the sound of the spatial audio signal(s) to output on a speaker associated with the computing device.

Figure 5:
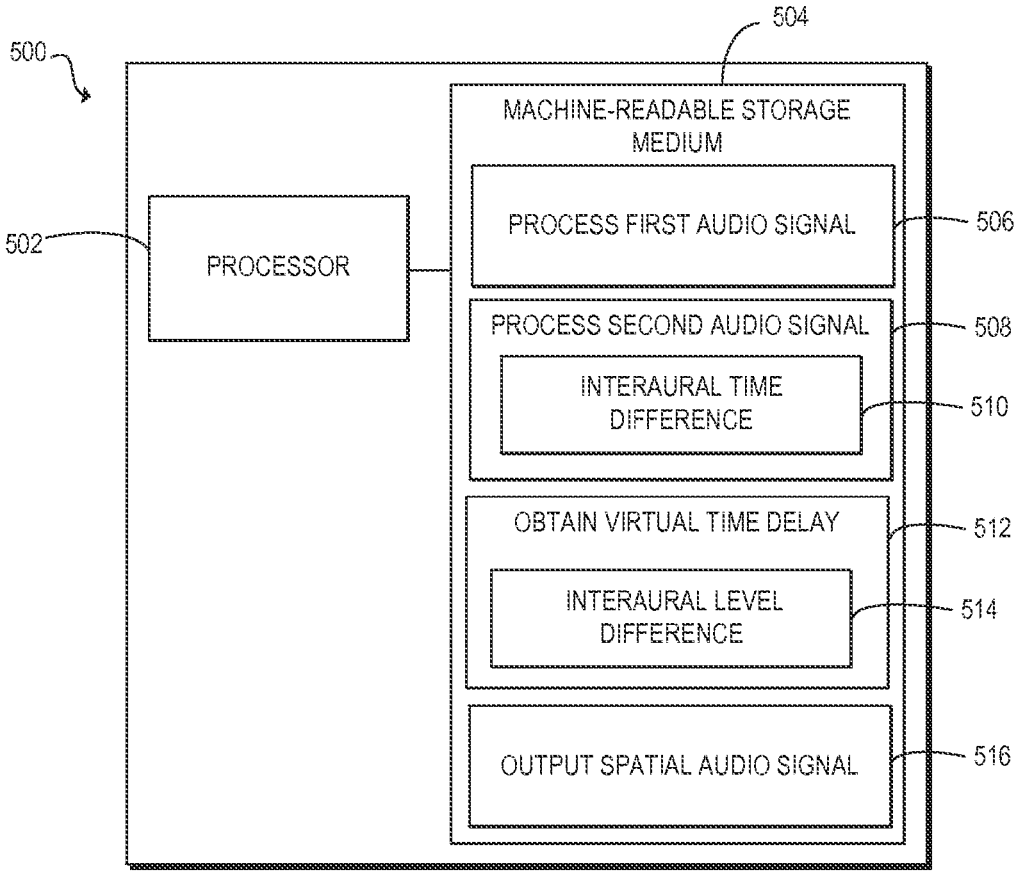
FIG. 5 is a block diagram of an example computing device with a processor to process a first and a second audio signal to output a spatial audio signal.

FIG. 5 is a flowchart of an example computing device 500 with a processor 502 to execute instructions to execute instructions 506-516 within a machine-readable storage medium 504. Specifically, the computing device 500 with the processor 502 is to process a first and a second audio signal to output a spatial audio signal.

Although the computing device 500 includes processor 502 and machine-readable storage medium 504, it may also include other components that would be suitable to one skilled in the art. For example, the computing device 500 may include the microphone array 104 as in FIG. 1. The computing device 500 is an electronic device with the processor 502 capable of executing instructions 506-516, and as such embodiments of the computing device 500 include a computing device, mobile device, client device, personal computer, desktop computer, laptop, tablet, video game console, or other type of electronic device capable of executing instructions 506-516. For example, the computing device 500 may be similar in structure and functionality to the computing device 102 as in FIG. 1.

The processor 502 may fetch, decode, and execute instructions 506-516 to output a spatial audio signal. Specifically, the processor 502 executes: instructions 506 to process a first audio signal received at a first microphone positioned at an actual distance from a second microphone; instructions 508 to process a second audio signal received at the second microphone, the second audio signal associated with an actual time delay relative to the first audio signal; instructions 510 to produce a spatial audio signal corresponding to an inter-aural time difference; instructions 512 to obtain a virtual time delay; instructions 514 to produce the spatial audio signal corresponding to the inter-aural level difference; and instructions 516 to output the spatial audio signal. In one embodiment, the processor 502 may be similar in structure and functionality to the processor 106 as in FIG. 1 to execute instructions 506-516. In other embodiments, the processor 502 includes a controller, microchip, chipset, electronic circuit, microprocessor, semiconductor, microcontroller, central processing unit (CPU), graphics processing unit (GPU), visual processing unit (VPU), or other programmable device capable of executing instructions 506-516.

The machine-readable storage medium 504 includes instructions 506-516 for the processor 502 to fetch, decode, and execute. In another embodiment, the machine-readable storage medium 504 may be an electronic, magnetic, optical, memory, storage, flash-drive, or other physical device that contains or stores executable instructions. Thus, the machine-readable storage medium 504 may include, for example, Random Access Memory (RAM), an Electrically Erasable Programmable Read-Only Memory (EEPROM), a storage drive, a memory cache, network storage, a Compact Disc Read Only Memory (CDROM) and the like. As such, the machine-readable storage medium 504 may include an application and/or firmware which can be utilized independently and/or in conjunction with the processor 502 to fetch, decode, and/or execute instructions of the machine-readable storage medium 504. The application and/or firmware may be stored on the machine-readable storage medium 504 and/or stored on another location of the computing device 500.

In summary, examples disclosed herein provide an enhanced audio quality by producing a spatial audio signal, even though spacing may be limited in the device housing the microphone elements. Additionally, the examples provide a more efficient method to obtain the spatial audio signal.

I claim:

1. A method comprising:

receiving a first audio signal at a first microphone positioned at an actual distance from a second microphone;

receiving a second audio signal at the second microphone, wherein the second audio signal is associated with an actual time delay relative to the first audio signal;

determining a virtual time delay corresponding to a virtual distance, wherein the virtual distance is different from the actual distance; and obtaining a spatial audio signal based on the distances and the time delays.

2. The method of claim 1 wherein the virtual time delay is greater than the actual time delay and the virtual distance is greater than the actual distance.

3. The method of claim 1 wherein obtaining the spatial audio signal based on the distances and the time delays is further comprising:

processing the first and the second audio signals to obtain a sound pressure level difference of the spatial audio signal.

4. The method of claim 1 wherein the first microphone and the second microphone are non-directional microphones.

5. The method of claim 1 wherein the actual distance is equal to or less than five centimeters and the virtual distance is greater than five centimeters.

6. The method of claim 1 further comprising:

outputting the spatial audio signal.

7. The method of claim 1 further comprising:

determining a virtual amplitude of the spatial audio signal based on the actual distance, virtual distance, and the virtual time delay.

8. A computing device comprising:

a microphone array to:

receive a first audio signal at a first microphone positioned at an actual distance from a second microphone;

receive a second audio signal at the second microphone, the second audio signal associated with an actual time delay relative to the first audio signal; and a processor to:

determine a virtual time delay corresponding to a virtual distance, wherein the virtual distance is greater than the actual distance; and determine a spatial audio signal based on the distances and the time delays.

9. The apparatus of claim 8 further comprising:

an output to render the spatial audio signal.

10. The computing device of claim 8 wherein to determine the spatial audio signal based on the distances and the time delays, the processor is further to:

determine a virtual amplitude of the spatial audio signal based on the time delays and distances.

11. The computing device of claim 8 wherein the virtual time delay is greater than the actual time delay.

12. A non-transitory machine-readable storage medium encoded with instructions executable by a processor of a computing device, the storage medium comprising instructions to:

process a first audio signal at a first microphone positioned at an actual distance from a second microphone;

process a second audio signal at a second microphone, wherein the second audio signal is associated with an actual time delay relative to the first audio signal;

obtain a virtual time delay based on the first and the second audio signal, the virtual time delay corresponding to a virtual distance greater than the actual distance; and output a spatial audio signal based on the distances and the time delays.

13. The non-transitory machine-readable storage medium of claim 12 wherein the second audio signal is associated with the actual time delay relative to the first audio signal is processed with the virtual time delay to produce another spatial audio signal corresponding to an inter-aural time difference.

14. The non-transitory machine-readable storage medium of claim 12 wherein to process the first and the second audio signal with virtual amplitudes to produce another spatial audio signal corresponding to an inter-aural level difference.

15. The non-transitory machine-readable storage medium of claim 12 wherein the first and the second microphone are non-directional microphones such that the first and the second audio signals are received without sensitivity in a direction.

16. The apparatus of claim 1, wherein the received first audio signal is delayed by the virtual time delay relative to the second audio signal when the first microphone is spaced apart from the second microphone by the virtual distance.

17. The computing device of claim 8, wherein the microphone array has a housing defining a maximum spacing between the first microphone and the second microphone, and the virtual distance is greater than the maximum spacing.

18. The non-transitory machine-readable storage medium of claim 12, wherein the virtual distance comprises a first distance in which, if the first and second microphones are positioned apart by the first distance, produces a corresponding larger pressure difference represented by signals received at the first and second microphones than a pressure difference represented by the first and second audio signals with the first and second microphones being positioned apart by the actual distance.

* * * * *